US005981407A

United States Patent [19]

Matsumoto et al.

[11] Patent Number: 5,981,407

[45] Date of Patent: Nov. 9, 1999

[54] THERMAL RESISTANCE-IMPROVED FLAME RETARDANT CLOTH

[75] Inventors: Takaharu Matsumoto, Takasago; Masayuki Adachi, Kobe; Akio Konishi, Kakogawa; Takahiro Ogawa, Kobe, all of Japan

[73] Assignee: Kaneka Corporation, Osaka, Japan

[21] Appl. No.: 09/180,285

[22] PCT Filed: May 12, 1997

[86] PCT No.: PCT/JP97/01597

§ 371 Date: Nov. 10, 1998

§ 102(e) Date: Nov. 10, 1998

[87] PCT Pub. No.: WO97/43475

PCT Pub. Date: Nov. 20, 1997

[30] Foreign Application Priority Data

May 13, 1996 [JP] Japan ..... 8-117862

[51] Int. Cl.[6] ..... D03D 15/00

[52] U.S. Cl. ..... 442/187; 442/197; 442/302; 442/307; 428/379; 428/389; 428/394

[58] Field of Search ..... 442/187, 197, 442/302, 307; 428/379, 389, 394

[56] References Cited

U.S. PATENT DOCUMENTS 5,348,796 9/1994 Ichibori et al. ..... 428/224

FOREIGN PATENT DOCUMENTS 52-99399 8/1977 Japan .
53-10745 1/1978 Japan .
53-6617 1/1978 Japan .
61-89339 5/1986 Japan .

*Primary Examiner*—Christopher Raimund
*Attorney, Agent, or Firm*—Armstrong, Westerman, Hattori, McLeland & Naughton

[57] ABSTRACT

Provided is a flame-retardant fabric comprising (A) from 16 to 45 parts by weight of a halogen-containing fiber containing from 11 to 67% by weight of a halogen chemically bound to a polymer and from 4 to 30% by weight of an Sb compound not chemically bound to a polymer, (B) from 10 to 36 parts by weight of a polyvinyl alcohol fiber, and (C) from 60 to 40 parts by weight of a polyester fiber, which are compounded to total 100 parts by weight. The flame-retardant fabric of the present invention has an excellent heat resistance, an excellent processability and a high flame retardance. This fabric can improve the feeling after high-temperature processing such as transfer printing and further widen the range of application of a polyester fiber product.

3 Claims, 1 Drawing Sheet

THERMAL RESISTANCE-IMPROVED FLAME RETARDANT CLOTH

FIELD OF THE INVENTION

The present invention relates to a flame-retardant fabric comprising a halogen-containing fiber, a polyvinyl alcohol fiber and a polyester fiber, and having an excellent heat resistance, an excellent processability and a high flame retardance.

BACKGROUND OF THE INVENTION

In recent years, it has been increasingly required to secure safety of food, clothing and shelter, and the necessity of flame-retardant materials has been in demand. Under such circumstances, the improvement of the designing by various prints in addition to the above-mentioned flame retardance and the improvement of deodorization have been in demand in the field of interior materials, especially curtains.

A method in which a flame retardance is imparted to general-purpose inflammable fibers by blending the same with highly flame-retardant fibers has been so far conducted. Especially, it is quite advantageous in view of a cost, a designing and a productivity that polyester fibers, the most general-purpose fibers are blended with highly flame-retardant fibers to form flame-retardant composite fibers. In recent years, composite fibers of polyester fibers and halogen-containing fibers, especially, modacrylic fibers are chiefly being used in flame-retardant curtain materials.

However, since acrylic fibers having a how heat resistance are used in this composite fiber product, the acrylic fibers are hardened in processing requiring a high temperature, such as transfer printing, providing a poor feeling. For this reason, the very product is actually not produced commercially.

SUMMARY OF THE INVENTION

The present invention has been made to solve the above-mentioned problems and to further widen the range of application of the polyester fiber product.

The present inventors have assiduously conducted investigations to solve the above-mentioned problems, and have consequently found that when a conventional fabric comprising a halogen-containing fiber containing an Sb compound and a polyester fiber is subjected to transfer-printing, a feeling is notably decreased, whereas when the composite fiber comprising the halogen-containing fiber containing the Sb compound and the polyester fiber is further blended with an inflammable polyvinyl alcohol fiber, a heat resistance can surprisingly be improved without impairing the flame retardance although the inflammable fiber is added. This finding has led to the completion of the present invention.

That is, the present invention relates to a flame-retardant fabric comprising (A) from 16 to 45 parts by weight of a halogen-containing fiber containing from 11 to 67% by weight of a halogen chemically bound to a polymer and from 4 to 30% by weight of an Sb compound not chemically bound to a polymer, (B) from 10 to 36 parts by weight of a polyvinyl alcohol fiber, and (C) from 60 to 40 parts by weight of a polyester fiber, which are compounded to total 100 parts by weight.

DETAILED DESCRIPTION OF THE PREFERRED EMBODIMENTS

Figure 1:
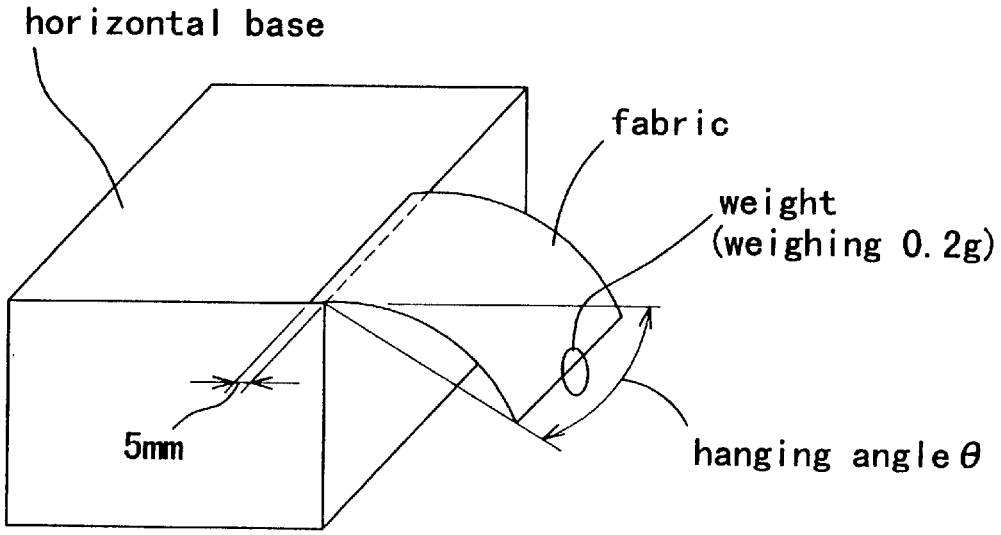
FIG. 1 is a view illustrating a method of evaluating a hardness of a fabric.

The fiber (A) constituting the flame-retardant fabric in the present invention contains from 11 to 67% by weight, preferably from 17 to 45% by weight of a halogen chemically bound to a polymer. Examples of the fiber (A) containing from 11 to 67% by weight of the halogen include a fiber formed of a polymer of a halogen-containing monomer, a fiber formed of a copolymer composed of the halogen-containing monomer and a halogen-free monomer, a polymer blend of a halogen-containing polymer and a halogen-free polymer, and a fiber formed of a halogen-containing polymer in which a halogen is introduced in the post treatment. However, these are not critical.

Specific examples of the halogen-containing polymer include a homopolymer of a halogen-containing monomer such as vinyl chloride, vinylidene chloride, vinyl bromide or vinylidene bromide, or a copolymer of two or more of these monomers; a homopolymer of a halogen-containing vinyl monomer or a halogen-containing vinylidene monomer such as acrylonitrile-vinyl chloride, acrylonitrile-vinylidene chloride, acrylonitrile-vinyl bromide, acrylonitrile-vinyl chloride-vinylidene chloride, acrylonitrile-vinyl chloride-vinyl bromide or acrylonitrile-vinylidene chloride-vinyl bromide, or a copolymer of at least one of these halogen-containing vinyl monomers and halogen-containing vinylidene monomers and acrylonitrile; a homopolymer of a halogen-containing vinyl monomer or a halogen-containing vinylidene monomer such as vinyl chloride, vinylidene chloride, vinyl bromide or vinylidene bromide, or a copolymer of at least one of these halogen-containing vinyl monomers and halogen-containing vinylidene monomers, acrylonitrile and a vinyl monomer or a vinylidene monomer copolymerizable therewith; a polymer obtained by addition-polymerizing an acrylonitrile homopolymer with a halogen-containing compound; and a halogen-containing polyester. However, these are not critical. Further, the above-mentioned homopolymers and copolymers may be mixed as required.

Examples of the vinyl monomer or the vinylidene monomer copolymerizable with the halogen-containing monomer include acrylic acid, acrylate, methacrylic acid, methacrylate, acrylamide, methacrylamide, vinyl acetate, vinylsulfonic acid, vinylsulfonate, methacrylsulfonic acid, methacrylsulfonate, styrenesulfonic acid and styrenesulfonate. These can be used either singly or in combination.

The polymer can be obtained from the halogen-containing monomer or this monomer and the monomer copolymerizable therewith by ordinary vinyl polymerization such as slurry polymerization, emulsion polymerization or solution polymerization, and the polymerization method is not particularly limited.

The fiber (A) formed of the above-mentioned halogen-containing fiber contains from 11 to 67% by weight, preferably from 17 to 45% by weight of a halogen. When the amount of the halogen is less than the above-mentioned range, the flame retardance of the fiber is unsatisfactory, making it hard to maintain a flame retardance of a final fabric product. When it exceeds the above-mentioned range, physical properties such as a strength and a heat resistance, a dyeability and a feeling of the fabric produced are not satisfactory. Accordingly, these are unwanted.

The Sb compound contained in the fiber (A) in an amount of from 4 to 30% by weight is an inorganic antimony compound. Examples thereof include antimony trioxide, antimony pentoxide, antimonic acid and antimony oxychloride. These may be used either singly or in combination. When the amount of the Sb compound is less than the above-mentioned range, it is difficult to render the composite fiber flame-retardant. When it exceeds the above-mentioned range, there occur problems of physical properties (a strength and an elongation) of the fabric produced, and problems in production such as nozzle clogging during the production of the fiber (A) and clogging of a filter cloth. Thus, these are unwanted.

The Sb compound is incorporated into the fiber (A) by a method in which a spinning dope is mixed with the above-mentioned Sb compound to produce the halogen-containing fiber constituting the fiber (A), or a method in which the Sb compound is incorporated by the post treatment in which the halogen-containing fiber is dipped into the Sb compound-containing binder aqueous solution and then subjected to squeezing, drying and heat treatment.

Further, in the present invention, the other flame retardant may be used in combination so long as the amount of the Sb compound relative to the polymer containing from 11 to 67% by weight of the halogen is maintained at from 4 to 30% by weight. Examples of the other flame retardant include an aromatic halogen compound such as hexabromobenzene; an aliphatic halogen compound such as a chlorinated paraffin; a halogen-containing phosphorus compound such as tris(2,3-dichloropropyl) phosphate; an organic phosphorus compound such as dibutyl aminophosphate; an inorganic phosphorus compound such as ammonium polyphosphate; an inorganic magnesium compound such as MgO, $Mg(OH)_2$ or $MgCO_3$; and an inorganic tin compound such as stannic oxide, metastannic acid, stannous oxyhalide and stannous hydroxide.

The polyvinyl alcohol fiber (B) used in the present invention is a fiber formed of a polymer obtained by formalizing from 0 to 60% of hydroxyl groups of polyvinyl alcohol. As a typical example thereof, Vinylon (trade name for a product of Kuraray Co., Ltd.) is mentioned.

Further, the polyester fiber (C) used in the present invention is a general polyester fiber composed mainly of polyethylene terephthalate. Examples thereof include a regular yarn, a finished yarn and a textured yarn obtained by conducting special treatment, such as a new synthetic yarn.

The flame-retardant fabric of the present invention comprises from 16 to 45 parts by weight of the halogen-containing fiber (A), from 10 to 36 parts by weight of the polyvinyl alcohol fiber (B) and from 60 to 40 parts by weight of the polyester fiber (C), which are compounded to total 100 parts by weight. More preferably, the fiber (A) is from 22 to 38 parts by weight, the fiber (B) is from 15 to 29 parts by weight, and the fiber (C) is from 42 to 55 parts by weight. When the amount of the halogen-containing fiber (A) in the fabric is less than the above-mentioned range, the flame retardance is decreased. When it exceeds the above-mentioned range, the heat resistance required for transfer printing is not obtained. Further, when the amount of the polyvinyl alcohol fiber (B) in the fabric is less than the above-mentioned range, the heat resistance required for transfer printing is not obtained while securing the flame retardance. When it exceeds the above-mentioned range, the flame retardance is hardly provided. Still further, when the amount of the polyester fiber (C) in the fabric is less than the above-mentioned range, the flame retardance required for transfer printing is not provided. When it exceeds the above-mentioned range, the flame retardance of the fabric cannot be maintained.

Specific examples of a method of forming a fabric by compounding these fibers (A) to (C) include a method in which all of the fibers (A) to (C) are blended and spun, and the spun yarn is formed into a fabric, a method in which a blended spun yarn of the fibers (A) and (B) and a spun yarn of the fiber (C) alone are used as a warp and a weft respectively, and formed into a fabric, and a method in which a spun yarn of the fiber (A) alone and a blended spun yarn of the fibers (B) and (C) are used as a warp and a weft respectively, and formed into a fabric. However, these methods are not critical.

Although the flame-retardant fabric of the present invention contains the inflammable polyvinyl alcohol fiber, it exhibits an excellent heat resistance and an excellent flame retardance for the following reasons. The heat resistance of the polyvinyl alcohol fiber improves the heat resistance of the fabric, and the heat shrinkage behavior of the polyvinyl alcohol fiber favors the flame retardance, making it possible to maintain a high flame retardance of the fabric.

When the flame-retardant fabric of the present invention is produced by compounding the halogen-containing fiber containing the Sb compound with the polyester fiber, the polyvinyl alcohol fiber is further used, making it possible to improve the heat resistance while maintaining the flame retardance and to improve the feeling after high-temperature processing such as transfer printing.

The present invention is illustrated more specifically by referring to the following Examples and Comparative Examples. However, the present invention is not limited thereto.

The flame retardance and the feeling of the fabric were evaluated by the following methods.

Flame Retardance

The flame retardance was evaluated by the JIS L 1091 A-1 method. Burning directions of the fabric were four directions, namely, warp, weft, face and back directions. The flame retardance was compared in terms of total average values of the carbonization areas. The smaller the carbonization area, the higher the flame retardance. In the burning test in the four directions, namely, the warp, weft, face and back directions, a fabric in which even only one piece was burned completely (a flame reached a frame by which to support the fabric) was estimated as completely burned because the average value could not be obtained.

Feeling (Heat Resistance)

A square fabric having a size of 5 cm×5 cm was heat-treated at 180° C. for 30 seconds using a scorch tester (Atlas Scorch Tester Type SO-5B, manufactured by Atlas Electric Device Co.). The feeling (heat treatment) was evaluated by the hardness of the thus-heat-treated fabric.

The fabric heat-treated with the scorch tester was hanged from a horizontal base, as shown in FIG. 1, while leaving a 5-mm portion of one side of the fabric, and was fixed on the base by adhering a cellophane tape to one side. A weight weighing 0.2 g was put on one side of the hanged tip. The hardness of the fabric was evaluated in terms of the hanging angle θ of the fabric at this time. Since this method is influenced by the warp and weft directions and the face and the back, the measured values were shown in terms of average values of the face, the back, the front and the rear in the warp and weft directions. The smaller the hanging angle θ, the harder the fabric. The larger the hanging angle θ, the softer the fabric.

EXAMPLES 1 AND COMPARATIVE EXAMPLES 1 AND 2

(1) Production of a Halogen-containing Fiber (1-1) Example 1

A copolymer comprising 51.0% by weight of acrylonitrile, 47.8% by weight of vinylidene chloride and 1.2% by weight of sodium styrenesulfonate was dissolved in dimethylformamide such that the resin concentration reached 30% by weight. To this resin solution were added 30% by weight of antimony trioxide to form a spinning dope. This spinning dope was extruded into a 30% dimethylformamide aqueous solution at a bath temperature of 20° C. from a nozzle having a nozzle hole diameter of 0.08 mm and a number of holes of 300, washed with water, and then dried at 130° C. for 8 minutes. The dried product was drawn three times at 130° C., and further heat-treated at 145° C. for 5 minutes to obtain a 2-denier halogen-containing fiber. To this halogen-containing fiber was added a finishing oil for spinning, and the resulting fiber was crimped, and cut to a length of 51 mm. The thus-obtained fiber contained 26.9% by weight of the halogen and 23.0% by weight of the Sb compound.

Fifty parts by weight of the thus-cut halogen-containing fiber and 50 parts by weight of the polyvinyl alcohol fiber (Vinylon BC-13, made by Kuraray Co., Ltd.; 1.4 denier, cut length—51 mm) were blended, and spun with No. 17 metric count.

(1-2) Comparative Example 1

A No. 17 metric count spun yarn was produced in the same manner as in Example 1 except that the spinning was conducted using 100% of the halogen-containing fiber.

(1-3) Comparative Example 2

A No. 17 metric count spun yarn was produced in the same manner as in Example 1 except that 50 parts by weight of a polyester fiber (made by Toray Industries Inc., 1.5 denier, cut length—51 mm) were used instead of the polyvinyl alcohol fiber (Vinylon).

(2) Production of a Fabric

Three types of woven fabrics of a 5-piece satin weave were produced using 130 polyester 150-denier wooly yarns per inch as a warp and 40 spun yarns per inch which were obtained in Example 1 and Comparative Example 1 or 2 as a weft.

(3) Evaluation of a Feeling (Heat Resistance) and a Flame Retardance

With respect to the above-mentioned three types of the woven fabrics, the feeling (heat resistance) and the flame retardance were evaluated. The results are shown in Table 1.

TABLE 1

| | Amounts of fibers (parts by weight) | | | Amount of an Sb compound in a woven fabric (% by weight) | Feeling (heat resistance) 180° C. × 30 seconds (hanging angle θ) | | Flame retardance Carbonization area ($cm^2$) |
|---|---|---|---|---|---|---|---|
| | Halogen-containing fiber | Polyvinyl alcohol fiber | Polyester fiber | | Warp direction | Weft direction | |
| Example 1 | 26 | 26 | 48 | 6.0 | 34° | 66° | 10.0 |
| Comparative Example 1 | 52 | — | 48 | 12.0 | 17° | 66° | 9.7 |
| Comparative Example 2 | 26 | — | 74 | 6.0 | 35° | 67° | completely burned |

As is clear from Table 1, the woven fabric of Example 1 produced by blending the spun yarn comprising the halogen-containing fiber containing the Sb compound and the polyvinyl alcohol fiber with the spun yarn formed of the polyester fiber exhibits a much improved feeling as compared with the woven fabric of Comparative Example 1 produced from the spun yarn of 100% of the halogen-containing fiber containing the Sb compound and the polyester fiber. Further, it has the same feeling as the fiber of Comparative Example 2 produced by blending the spun yarn comprising 50 parts of the halogen-containing fiber containing the Sb compound and 50 parts of the polyester fiber with the spun yarn formed of the polyester fiber. On the other hand, with respect to the flame retardance, the woven fabric of Example 1 exhibits the same flame retardance as that of Comparative Example 1. Although the amount of the flame retardant of the overall woven fabric is decreased, the satisfactory flame retardance is secured.

EXAMPLE 2 AND COMPARATIVE EXAMPLES 3 AND 4

(1) Production of a Halogen-containing Fiber (1-1) Example 2

Example 1 was repeated except that the amount of antimony trioxide was changed to 6% by weight based on the resin to obtain a halogen-containing fiber containing 33.0% by weight of the halogen and 5.6% by weight of the Sb compound. A No. 17 metric count spun yarn was produced using 75 parts by weight of this halogen-containing fiber and 25 parts by weight of the same polyvinyl alcohol fiber (Vinylon) as used in Example 1.

(1-2) Comparative Example 3

A No. 17 metric count spun yarn was produced in the same manner as in Example 2 except that the spinning was conducted using 100% of the halogen-containing fiber.

(1-3) Comparative Example 4

A No. 17 metric count spun yarn was produced in the same manner as in Example 2 except that the spinning was conducted using 75 parts by weight of the halogen-containing fiber and 25 parts by weight of the polyester fiber.

(2) Production of a Fabric

Three types of woven fabrics of a 5-piece satin weave were produced using the same 130 polyester 150-denier wooly yarns per inch as described above as a warp and 40 spun yarns per inch which were obtained in Example 2 and Comparative Example 3 or 4 as a weft.

(3) Evaluation of a Feeling (Heat Resistance) and a Flame Retardance

With respect to the above-mentioned three types of the woven fabrics, the feeling (heat resistance) and the flame retardance were evaluated. The results are shown in Table 2.

TABLE 2

| | Amounts of fibers (parts by weight) | | | Amount of an Sb compound in a woven fabric (% by weight) | Feeling (heat resistance) 180° C. × 30 seconds (hanging angle θ) | | Flame retardance Carbonization area ($cm^2$) |
|---|---|---|---|---|---|---|---|
| | Halogen-containing fiber | Polyvinyl alcohol fiber | Polyester fiber | | Warp direction | Weft direction | |
| Example 2 | 39 | 13 | 48 | 2.2 | 13° | 61° | 6.0 |
| Comparative Example 3 | 52 | — | 48 | 2.9 | 9° | 36° | 9.6 |
| Comparative Example 4 | 39 | — | 61 | 2.2 | 12° | 61° | completely burned |

As is clear from Table 2, the feeling is satisfactorily improved only by adding 13 parts by weight of the polyvinyl alcohol fiber to the woven fabric formed of the halogen-containing fiber containing the Sb compound and the polyester fiber. Further, the flame retardance is satisfactorily provided even by decreasing the amount of the Sb compound.

EXAMPLE 3 AND COMPARATIVE EXAMPLES 5 AND 6

(1-1) Example 3

Example 1 was repeated except that the amount of antimony trioxide was changed to 10% by weight based on the resin to obtain a halogen-containing fiber containing 31.8% by weight of the halogen and 9.1% by weight of the Sb compound. A No. 17 metric count spun yarn was produced using 60 parts by weight of this halogen-containing fiber and 40 parts by weight of the same polyvinyl alcohol fiber (Vinylon) as used in Example 1.

(1-2) Comparative Example 5

A No. 17 metric count spun yarn was produced in the same manner as in Example 3 except that the spinning was conducted using 100% of the halogen-containing fiber.

(1-3) Comparative Example 6

A No. 17 metric count spun yarn was produced in the same manner as in Example 3 except that the spinning was conducted using 60 parts by weight of the halogen-containing fiber and 40 parts by weight of the polyester fiber.

(2) Production of a Fabric

Three types of woven fabrics of a 5-piece satin weave were produced using the same 130 polyester 150-denier wooly yarns per inch as described above as a warp and 40 spun yarns per inch which were obtained in Example 3 and Comparative Example 5 or 6 as a weft.

(3) Evaluation of a Feeling (Heat Resistance) and a Flame Retardance

With respect to the above-mentioned three types of the woven fabrics, the feeling (heat resistance) and the flame retardance were evaluated. The results are shown in Table 3.

TABLE 3

| | Amounts of fibers (parts by weight) | | | Amount of an Sb compound in a woven fabric (% by weight) | Feeling (heat resistance) 180° C. × 30 seconds (hanging angle θ) | | Flame retardance Carbonization area ($cm^2$) |
|---|---|---|---|---|---|---|---|
| | Halogen-containing fiber | Polyvinyl alcohol fiber | Polyester fiber | | Warp direction | Weft direction | |
| Example 3 | 31 | 21 | 48 | 2.8 | 25° | 68° | 5.8 |
| Comparative Example 5 | 52 | — | 48 | 4.7 | 15° | 66° | 6.3 |
| Comparative Example 6 | 31 | — | 69 | 2.8 | 30° | 68° | completely burned |

As is clear from Table 3, the spun yarn of Example 3 exhibits a high heat resistance while maintaining a flame retardance.

EXAMPLE 4 AND COMPARATIVE EXAMPLES 7 AND 8

(1) Production of a Halogen-containing Fiber (1-1) Example 4

A copolymer comprising 49.5% by weight of acrylonitrile, 49.7% by weight of vinyl chloride and 0.8% by weight of sodium styrenesulfonate was dissolved in acetone such that the resin concentration reached 27% by weight. To this resin solution were added 6% by weight, based on the resin, of antimony trioxide to form a spinning dope. This spinning dope was extruded into a 30% acetone aqueous solution at a bath temperature of 25° C. from a nozzle having a nozzle hole diameter of 0.08 mm and a number of holes of 300, washed with water, and then dried at 130° C. for 5 minutes. The dried product was drawn three times at 130° C., and further heat-treated at 145° C. for 5 minutes to obtain a 2-denier halogen-containing fiber. To this halogen-containing fiber was added a finishing oil for spinning, and the resulting fiber was crimped, and cut to a length of 51 mm. The thus-obtained fiber contained 28.2% by weight of the halogen and 5.7% by weight of the Sb compound.

Fifty parts by weight of the thus-cut halogen-containing fiber and 50 parts by weight of the polyvinyl alcohol fiber (Vinylon BC-13, made by Kuraray Co., Ltd.; 1.4 denier, cut length—51 mm) were blended, and spun with No. 17 metric count.

(1-2) Comparative Example 7

A No. 17 metric count spun yarn was produced in the same manner as in Example 4 except that the spinning was conducted using 100% of the halogen-containing fiber.

(1-3) Comparative Example 8

A No. 17 metric count spun yarn was produced in the same manner as in Example 4 except that 50 parts by weight of a polyester fiber were used instead of the polyvinyl alcohol fiber.

(2) Production of a Fabric

Three types of woven fabrics of a 5-piece satin weave were produced using the same 130 polyester 150-denier wooly yarns per inch as described above as a warp and 40 spun yarns per inch which were obtained in Example 4 and Comparative Example 7 or 8 as a weft.

(3) Evaluation of a Feeling (Heat Resistance) and a Flame Retardance

With respect to the above-mentioned three types of the woven fabrics, the feeling (heat resistance) and the flame retardance were evaluated. The results are shown in Table 4.

TABLE 4

| | Amounts of fibers (parts by weight) | | | Amount of an Sb compound in a woven fabric (% by weight) | Feeling (heat resistance) 180° C. × 30 seconds (hanging angle θ) | | Flame retardance Carbonization area ($cm^2$) |
|---|---|---|---|---|---|---|---|
| | Halogen-containing fiber | Polyvinyl alcohol fiber | Polyester fiber | | Warp direction | Weft direction | |
| Example 4 | 26 | 26 | 48 | 1.5 | 64° | 11° | 5.1 |
| Comparative Example 7 | 52 | — | 48 | 3.0 | 50° | 12° | 5.3 |
| Comparative Example 8 | 26 | — | 74 | 1.5 | 34° | 0° | completely burned |

As is clear from Table 4, the spun yarn of Example 4 exhibits a high heat resistance while maintaining a flame retardance.

What is claimed is:

1. A flame-retardant fabric comprising (A) from 16 to 45 parts by weight of a halogen-containing fiber containing from 11 to 67% by weight of a halogen chemically bound to a polymer and from 4 to 30% by weight of an Sb compound not chemically bound to a polymer, (B) from 10 to 36 parts by weight of a polyvinyl alcohol fiber, and (C) from 60 to 40parts by weight of a polyester fiber, which are compounded to total 100 parts by weight.

2. The flame-retardant fabric of claim 1, wherein said halogen-containing fiber (A) is a halogen-containing fiber formed of a copolymer comprising from 30 to 70% by weight of acrylonitrile, from 70 to 30% by weight of at least one of a halogen-containing vinyl monomer and a halogen-containing vinylidene monomer, and from 0 to 10% by weight of at least one of a vinyl monomer and a vinylidene monomer copolymerizable therewith.

3. The flame-retardant fabric of claim 1 or 2, which is formed by compounding a blended spun yarn of the halogen-containing fiber (A) and the polyvinyl alcohol fiber (B) with a spun yarn of the polyester fiber (C).

* * * * *